US005964052A

United States Patent [19]

Jepsen et al.

[11] Patent Number: 5,964,052

[45] Date of Patent: Oct. 12, 1999

[54] WIND RESISTANT REINFORCED SIGN AND BASE THEREFOR

[75] Inventors: J. Scott Jepsen; Bryan Aukamp, both of St. Louis; Erin K. Price, St. Charles; Tracy D. Ramsaroop, St. Louis, all of Mo.

[73] Assignee: Stout Industries, Inc., St. Louis, Mo.

[21] Appl. No.: 08/768,980

[22] Filed: Dec. 18, 1996

[51] Int. Cl.[6] ..... G09F 15/00

[52] U.S. Cl. ..... 40/606; 40/612

[58] Field of Search ..... 40/606, 610, 612, 40/27; 248/165, 188.5

[56] References Cited

U.S. PATENT DOCUMENTS

| | | | |
|---|---|---|---|
| 626,256 | 6/1899 | Webb . | |
| 646,807 | 4/1900 | Crocker | 40/27 |
| 1,541,200 | 6/1925 | Thomson . | |
| 1,750,118 | 3/1930 | Mueller, Jr. et al. . | |
| 2,165,704 | 7/1939 | Hood . | |
| 2,557,399 | 6/1951 | Teetor . | |
| 2,771,261 | 11/1956 | Niggeloh | 248/188.5 |
| 3,422,556 | 1/1969 | Lyons et al. . | |
| 3,525,493 | 8/1970 | Chrietzberg et al. . | |
| 3,646,696 | 3/1972 | Sarkisian . | |
| 3,662,482 | 5/1972 | Sarkisian . | |
| 3,868,630 | 2/1975 | Lesondak | 40/606 X |
| 4,024,659 | 5/1977 | Ingerdahl | 248/188.5 X |
| 4,288,053 | 9/1981 | Sarkisian . | |
| 4,509,714 | 4/1985 | Seely . | |
| 4,516,344 | 5/1985 | Seely | 40/606 X |
| 4,691,892 | 9/1987 | Grewe et al. | 40/611 X |
| 4,783,921 | 11/1988 | George . | |
| 4,878,303 | 11/1989 | Banniza et al. | 40/610 X |
| 5,028,031 | 7/1991 | Stoudt . | |
| 5,040,321 | 8/1991 | Stoudt | 40/610 X |
| 5,079,861 | 1/1992 | Stoudt . | |
| 5,094,023 | 3/1992 | McVey | 248/188.5 X |
| 5,095,642 | 3/1992 | George et al. . | |
| 5,371,964 | 12/1994 | Kubacki et al. . | |

FOREIGN PATENT DOCUMENTS

| | | | |
|---|---|---|---|
| 2240207 | 7/1991 | United Kingdom | 40/606 |
| 2240868 | 8/1991 | United Kingdom | 40/606 |

*Primary Examiner*—Brian K. Green
*Attorney, Agent, or Firm*—Paul M Denk

[57] ABSTRACT

A wind resistance sign having a panel, a base portion, the base portion securing the bottom of the panel thereto, one or more legs connected to the base portion to support the sign when erected, a flange provided for securing the bottom of the sign panel to the base portion, a reinforcing plate provide adjacent the flange of the base portion, and the legs of the sign capable of being removable from its erected position.

7 Claims, 4 Drawing Sheets

WIND RESISTANT REINFORCED SIGN AND BASE THEREFOR

CROSS-REFERENCE TO RELATED APPLICATION:

This application is designated as a continuation of the application of the same inventor, having Ser. No. 08/768,980, filed on Dec. 16, 1996, said application being owned by a common assignee.

BACKGROUND OF THE INVENTION

Street signs are often employed by shopkeepers to display messages in front of their stores, or in aisles to display various messages to their customer. Occasionally, these signs are located outside of the building, and frequently, they are used to display advertisements at drive-in type facilities, such as service stations, quick service installations, and the like. Particularly when these types of signs are used outside, wind has a tendency to cause their bending, under the force exerted by shifting winds, and signs of this type are generally constructed to give with the wind pressure, and hopefully avoid turning over, and further avoid cracking or breaking, even over a period of time. These street signs generally include a sign panel supported by a base assembly having legs. The legs, however are generally fixed. Because the legs are fixed, it is difficult to pass the sign through doorways and other constricted areas. Further, these signs are often exposed to weather conditions, as previously explained, and particularly wind, that has an adverse impact upon the useful life of the signs. The persistent swaying action upon the sign that the wind produces causes fatigue at the lower portion of the sign, where the sign panel meets the sign retaining or supporting member. Eventually, this fatigue causes the panel to fail, either completely breaking off or impairing its ability to stand vertically. Other prior art signs have attempted to overcome this wind problem, but each has features that either renders the sign expensive to produce, or causes unfortunate occurrences, such as excessive motion of the sign which makes it difficult to read.

Various types of signs and their constructions, for use for display purposes. can be found in the prior art. For example, the patent to Capper, U.S. Pat. No. 2,467,187, discloses a weighted pivotal sign, which is designed primarily to provide for the pivotal movement of its sign portion, in order to accommodate wind gusts. The patent to Sarkisian, U.S. Pat. No. 3,646,696, discloses a similar type of poster display device, which is spring mounted, for the purpose of providing means for reducing the effects of lateral forces that normally have a tendency to topple the display device. The U.S. Pat. to Stoudt, No. 5,079,861, discloses a quick set-up sign stand, where its apparently wind resistant sign is mounted to a leg assembly. Another patent to Stoudt, U.S. Pat. No. 5,028,031, shows a related type of sign and flag holder. It has an upwardly extending pair of plates, for elevating the shown sign. A further patent to Stoudt, U.S. Pat. No. 5,040,321, shows a quick set-up sign stand. The patent to Seely, U.S. Pat. No. 4,509,714, shows a portable wind-resistant sign stand with flexible bow-type legs. The patent to Thomson, U.S. Pat. No. 1,541,200, shows a further type of sign stand. The patent to Webb, U.S. Pat. No. 626,256, discloses a storm proof sign, that is supported upon a tiltable type base. The patent to Lyons, U.S. Pat. No. 3,422,556, shows an identifying marker held by a base member. Another patent to Sarkisian, U.S. Pat. No. 3,662,482, shows a related type of apparatus identified as a poster display device. The patent to Ilillstrom, U.S. Pat. No. 4,033,536, discloses a mounting bracket coil spring for a sign. Another patent to Sarkisian, U.S. Pat. No. 4,288,053, discloses an adjustable sign mounting bracket. The patent to Seely, U.S. Pat. No. 4,548,379, discloses a compact sign and stand. Another patent to Seely, U.S. Pat. No. 4,569,499, discloses a deflectable sign and stand. A further patent to Seely, U.S. Pat. No. 4,593,879, shows another compact sign stand. The patent to Grewe, U.S. Pat. No. 4,691,892, shows a further type of spring biased mounted sign and sign stand. A further patent to Sarkisian, U.S. Pat. No. 4,265,040, discloses a related type of development upon a two-sides display device. The patent to Kubacki, U.S. Pat. No. 5,371,964, discloses a display sign with collapsible support base.

A further patent to Seely, U.S. Pat. No. 4,516,344, discloses a portable wind resistant sign stand with flexible sign. Finally, reissue patent U.S. Pat. No. Re.32,359, also to Seely, shows a portable wind-resistant sign stand with flexible sign.

U.S. Pat. No. 4,783,921, and which is owned by a common assignee to this application, discloses a mounting arrangement for wind deflectable bending sign. U.S. Pat. No. 5,095,642, and which is also owned by a common assignee to this current application, shows a type of foldable sign. In fact, it its the improvements made to means for attaching the bottom of the sign to its base, as disclosed in this patent, that constitutes one of the innovations of this current invention.

SUMMARY OF THE INVENTION

The principal object of this invention is to provide a wind resistant sign which is reinforced to sustain its useful life, and which is mounted upon a removable base, to facilitate its transit and storage.

In accordance with this invention, generally stated, there is provided a wind resistant sign. The sign includes a sign panel, a base assembly which receives the sign panel, and incorporates interlocking leg means connected to the base assembly. The leg means are formed as two pairs of complementary parts, which mate to form the two legs of the base. The base also includes an upwardly and outwardly directed flat blade, on one or both sides of the bottom of the sign, which provides support and superior resistance to material fatigue in the proximate panel portion of the sign, during sustained usage.

It is, therefore, an object of this invention to provide a reinforced wind resistant sign.

Another object of this invention is to provide a sign panel with improved base supporting means.

Yet another object of this invention is to provide a wind resistant sign which incorporates a base which can be disassembled.

Still another object of this invention is to provide a wind resistant sign that has greatly enhanced characteristics, through the use of flat blade supports, and which significantly enhances the resistance of the sign to crack or fatigue, even thought subjected to repeat bendings, through resistance to wind, during its usage and application.

Still another object of this invention is to produce a wind resistant sign which is easy to manufacture.

A further object of this invention is to provide a sign, generally fabricated of metal or polymer components, which exhibits significant stability to function as a display sign that may be exposed to a variety of detrimental weather conditions, such as inclement weather that may be encountered outdoors, enhanced by rain, snow, and excessive wind.

Still another object of this invention is to provide an enlarged sign that may be disassembled in order to reduce its size to facilitate its shipment and storage.

Yet another object is to provide a wind resistant sign, which can be quickly assembled, or even taken apart without the need for usage of any tools.

These and other objects may become more apparent to those skilled in the art upon reviewing the summary of this invention, and upon undertaking a description of its preferred embodiment, in light of the drawings.

DESCRIPTION OF THE PREFERRED EMBODIMENT

Figure 1:
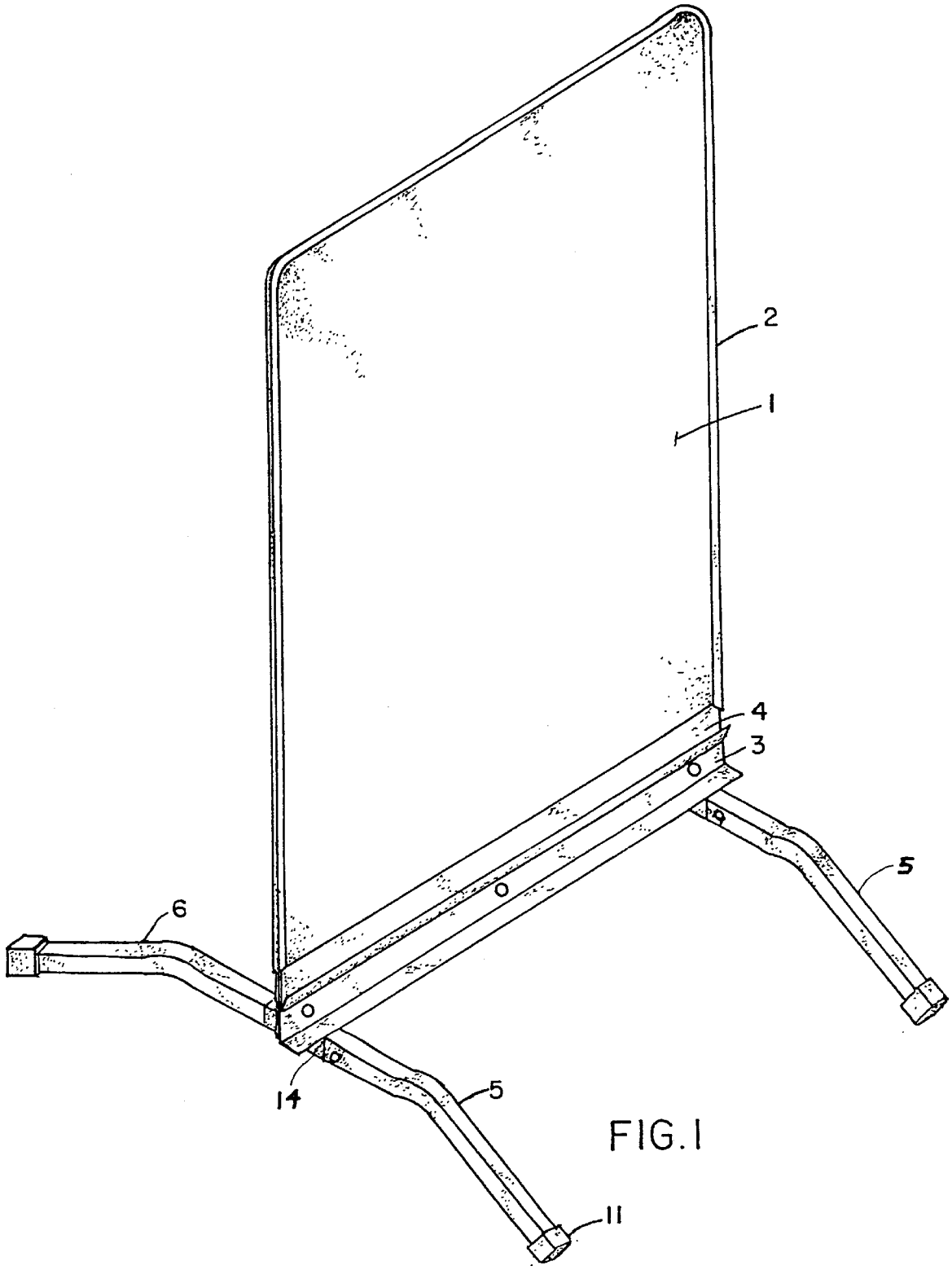
FIG. 1 is an isometric view of a sign of the present invention.
Figures 2, 2A:
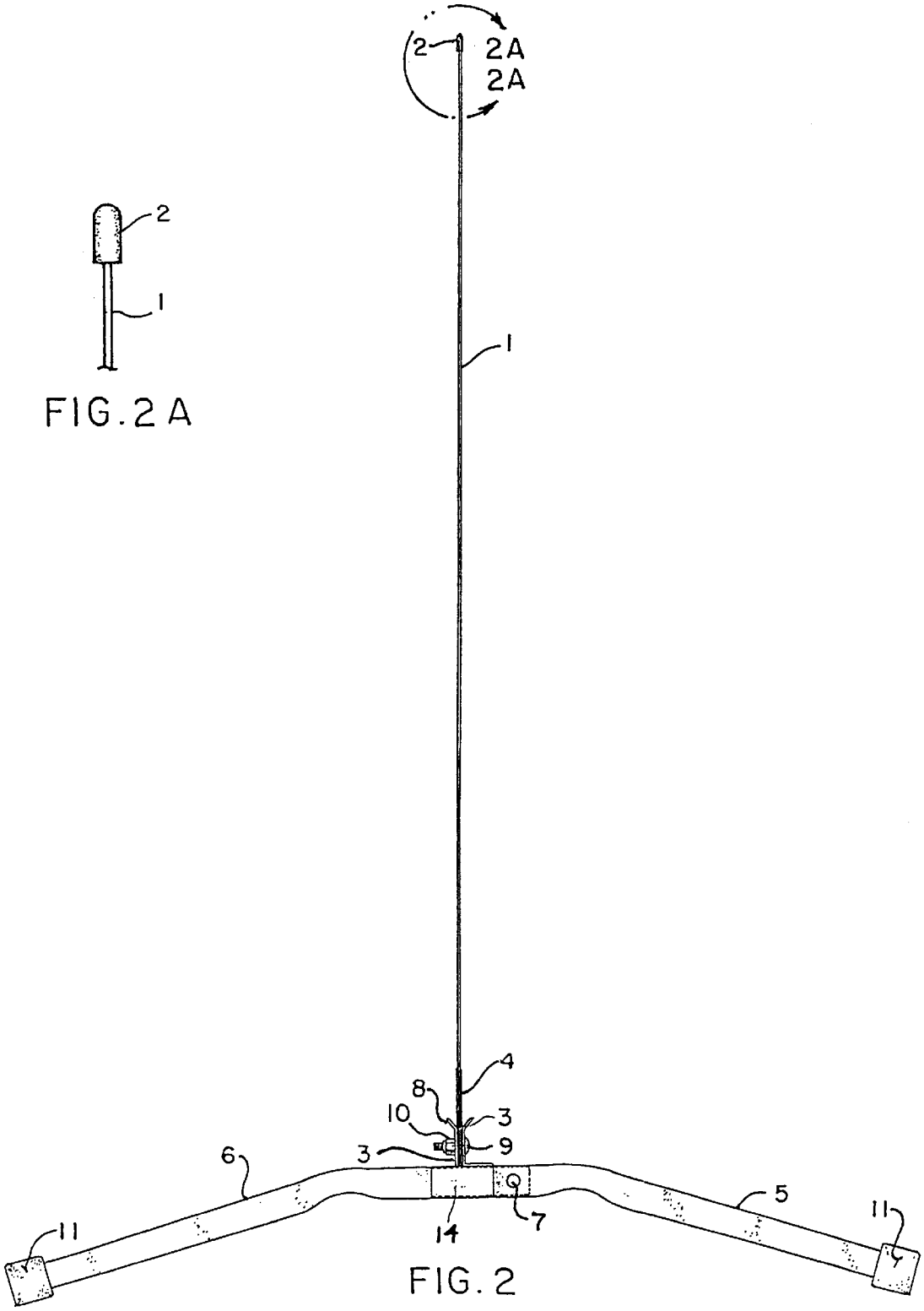
FIG. 2 is a side elevational view of the sign and its supporting base of this invention.
FIG. 2A is a partial detailed view of the upper end of the sign as shown at 2A—2A of FIG. 2.
Figure 3:
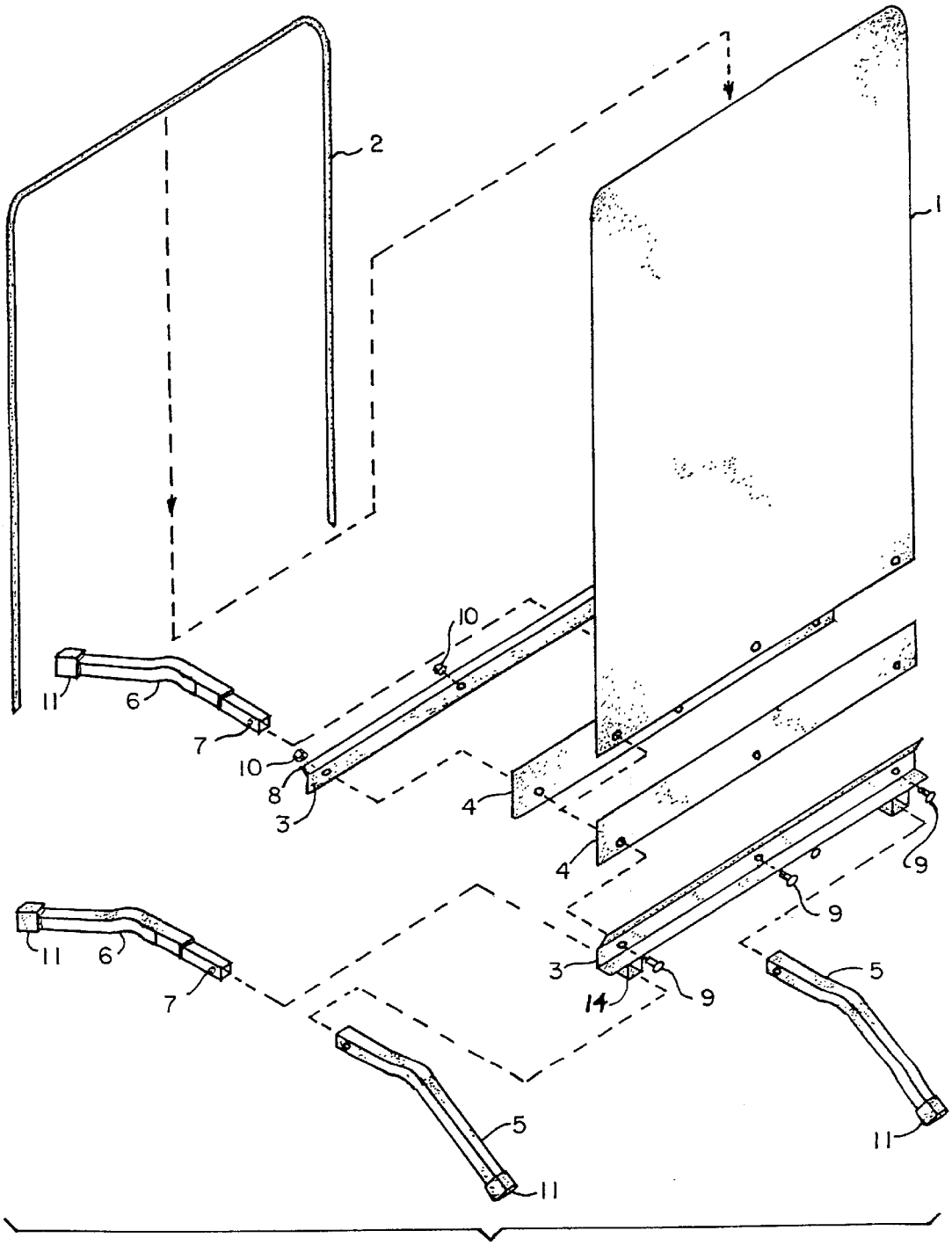
FIG. 3 is an exploded isometric view of a sign of the present invention.

In referring to the drawings, and in particular FIGS. 1 through 3, the sign panel 1, surrounded by a reinforcing frame 2, is shown mounted upon its base assembly, which includes the pair of flange members 3, supported upon the leg bases 5 and 6, when interconnected together. The principal purpose of the reinforcing frame is to provide a trim lock or cushioned edging to protect and eliminate against any sharp peripheral edges for the resilient sign. The base, between the flanges 3, includes the flat plate or blade supports 4, preferably one to either side of the sign 1, and which as subsequently described, significantly reinforces the sign, at this position, against fracture.

As can be seen, the sign edge frame, or trim lock edging, 2 extends entirely around the perimeter of the sign 1, as shown in FIG. 2A.

At the base of the sign, the legs 5 and 6 interconnect together, through the sliding telescopic insertion of one leg within the other, and an aperture is provided within the legs to support the attachment therein, of the spring clip 7, to hold the two sides of the legs together, when interconnected. The flanges 3 have a series of apertures provided therethrough, and through which a fastening means, such as disclosed at 9 and 10, are spacedly inserted therethrough, to hold the base of the sign, and its reinforcing plates 4, within the flanges 3, as can be noted. The upper edges of the flanges 3 are beveled outwardly, as can be seen at 8, for the purpose of providing clearance for the sign, and its reinforcing plates 4, therein, and to allow for their slight bending, when excessive forces are exerted upon them.

The legs 5 and 6 include outer end caps 11, which may be fabricated of rubber, plastic, or the like to facilitate their support.

As can be further seen in the exploded view of FIG. 3, the leg 6 includes an extension, which is of reduced proportions, and includes the apertures therethrough, into which the spring clips 7 insert. Then, the leg 5, which is of the same cross-sectional dimension as the leg 6, slides over the reduced portion of the leg 6, and its shown proximate end aperture accommodates the spring clip 7 therethrough, for securing the legs together, in the manner as can be seen in FIG. 1. The generally assembly of the sign, and its interconnecting components, can be easily determined from reviewing this exploded isometric view of this wind resistant sign, when assembled. The legs 5 and 6 cooperate with the sleeve 14 when securing the legs together, the sleeve 14 being provided at the base of the sign, proximate its pair of flange members 3.

Figures 4, 5, 6, 7, 8:
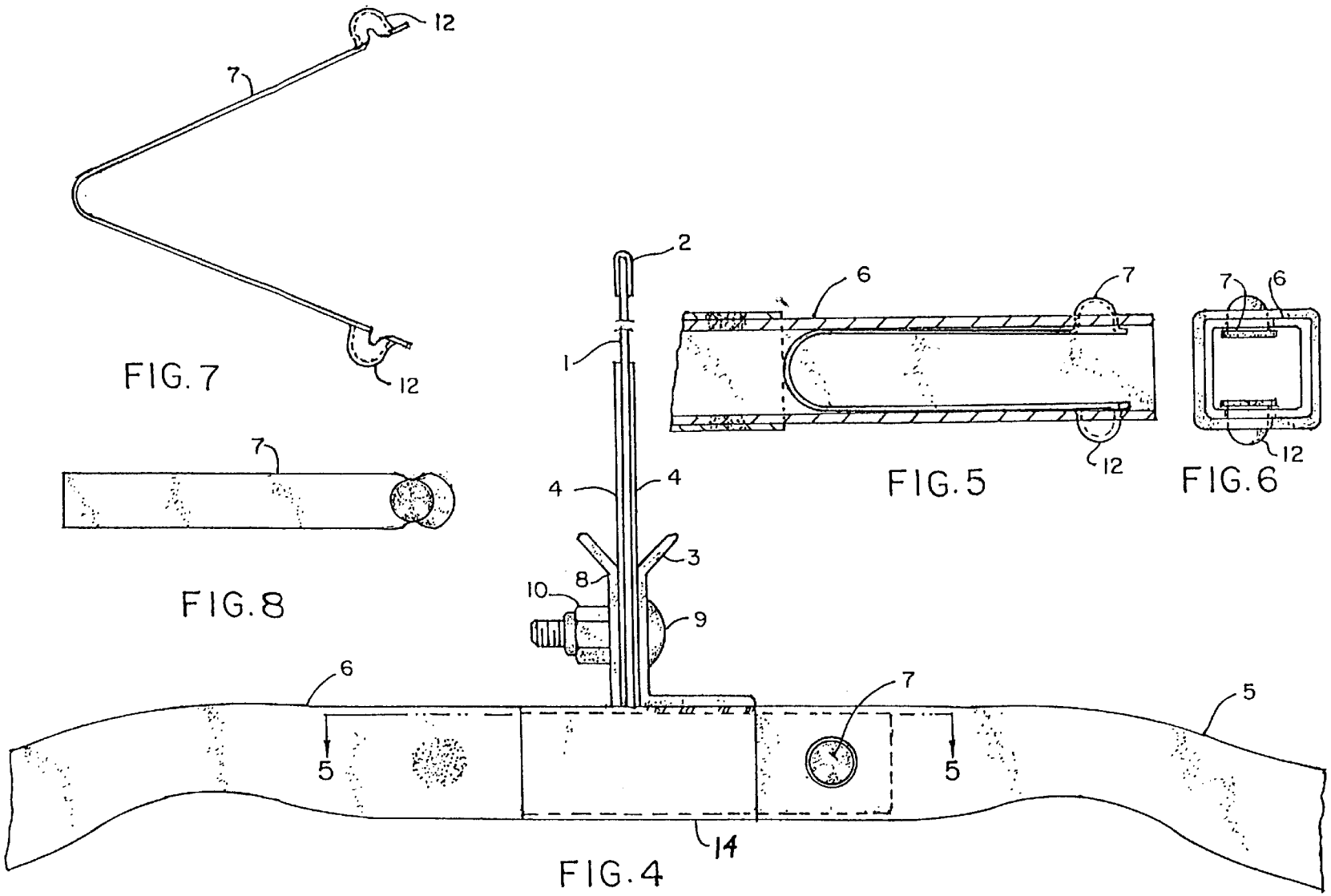
FIG. 4 is a partial detailed side elevational view of the sign of the present invention, taken along the bottom of the sign and where it connects with its supporting base.
FIG. 5 is a partial sectional side elevational view of the interconnecting legs of the sign base, taken along the line 5—5 of FIG. 4.
FIG. 6 is a partial sectional view of the two interconnecting legs, and their spring clip, taken along the line 6—6 of FIG. 5.
FIG. 7 is a top view of the spring clip of the present invention.
FIG. 8 is a side view of the spring clip of FIG. 7.

FIGS. 7 and 8 disclose in greater detail the construction of the spring clip 7. It is made of resilient steel, or hard plastic, and includes the outwardly extending pressed portions 12, and which extend through the various apertures of the legs, as previously explained, to provide for their interconnection together. Simply pressing inwardly upon the locking members 12, against the resilience of their spring clip 7, allows for the leg 5 to be disassembled and slid from the leg 6, when it is desired to disassemble the base of the sign. Then, a removal of the fastening means 9 and 10, allows the sign to be separated from is base, in the event that storage becomes necessary.

It can be seen that the reinforcing plates 4 extend approximately the full width of the sign, and extend upwardly for some distance upon the base of the sign, and the reinforcing plates have been found to be very effective in preventing the cracking of the sign 1 at this location, due to repeat bendings when subjected to wind pressure or persons pushing upon the sign, from either direction, as frequently occurs. These reinforcing plates can be made of metal, such as aluminum, steel, or the like, or of a polymer, such as acrylic or a Lexan, in order to provide for support at this location, and in the event that they are made of a transparent plastic, they allow the lower segment of the sign to yet be viewed, through them, without obstruction.

The type of connection of the sign as shown in the assignee's previous patent U.S. Pat. No. 5,095,642, where the interconnecting means 13 provides the only means for support of its sign 3, has been found, through testing, that these types of base supports, through testing, when subjected to continuous bending, in alternate directions, can fatigue at approximately 12,000 cycles. But, with the addition of the reinforcing plate or blade support of this invention, such as the plates 4, a thirty inch sign did not show signs of failure or fatigue until 85,000 cycles of alternate shifting of the signs were made. In addition, wherein acrylic or a Lexan style of reinforcing plate was employed, for supporting the sign 1 in position, failure or fatigue was not noted until approximately 56,500 cycles of alternate movement of the sign was made. Hence, the addition of the reinforcing plates to the sign, at the location noted, has significantly enhanced the effectiveness of these wind resistant signs, fabricated in accordance with the teachings of this invention, against breakage and fatigue, at a greatly enhanced percentage from that type of interconnection and support for the signs as shown in the prior art.

The current invention, for a wind resistant sign, can be fabricated and assembled of various models, such as one incorporating a hinge leg, or a folding leg, such as shown in the assignee's prior patent U.S. Pat. No. 5,095,642, upon foldable sign. Furthermore, this concept may be used with a snap leg concept, for interconnecting a series of legs together, as shown in this current invention. In addition, the base types for holding the wind resistant sign of this invention in place can be fabricated as a two-piece fixed leg, or a four-piece fixed leg assembly. These are examples of the alternate types of bases that may be used in the assembly of this wind resistant sign, for production.

Variations or modifications to the subject matter of this invention may occur to those skilled in the art upon reviewing the invention as described herein. Such variations or modifications, if within the spirit of this invention, are intended to be encompassed within the scope of any claims to patent protection issuing upon this design. The description of the preferred embodiment set forth herein is done so for illustrative purposes only.

Having thus described the invention, what is claimed and desired to be secured by letters patent is:

1. A wind resistant sign for locating above a supporting surface, comprising a panel, said panel having a bottom and sides, a base portion, said base portion being elevated for allowing wind to pass under the sign, said base portion secured to the bottom of said panel and said base portion having side edges, a series of at least four legs connected to the base portion, each leg having a bend therein for elevating said panel and said base portion of the sign above any supporting surface upon which it sets, a pair of said legs being located proximate each side of said panel, each of said pair of legs being proportioned to provide for their connecting together for supporting the panel, a pair of sleeves, one of each sleeve attaching beneath and perpendicular to the sign base portion proximate each side of the panel, each sleeve cooperating with two of said legs to secure the pair of legs in place and interfitting within the said sleeve for supporting the sign when used, said base portion including a means for securing the bottom of said panel to the base portion, each pair of legs are mated together through a removable interconnection, and one leg of each pair extending from opposite sides of the base portion, fastening means for interconneting each pair of legs together, and said fastening means comprising a spring clip.

2. The wind resistant sign of claim 1 wherein one leg of each pair of legs inserts within the other leg to provide for their interconnection together.

3. The wind resistant sign of claim 1 and including at least one reinforcing plate provided adjacent the securing means of the base portion, said reinforcing plate provided for furnishing resistance against bending of the sign to retard sign fracture at its location of connection to the base portion.

4. The wind resistant sign of claim 3 wherein there are a pair of reinforcing plates arranged adjacent the securing means of the base portion.

5. The wind resistant of claim 4 wherein said reinforcing plates extend approximately from side to side of the base portion.

6. The wind resistant sign of claim 5 wherein reinforcing plates extend upwardly from the securing means of the base portion.

7. The wind resistant sign of claim 6 wherein said reinforcing plates and the securing means extend from side to side of the base portion.

* * * * *

UNITED STATES PATENT AND TRADEMARK OFFICE

CERTIFICATE OF CORRECTION

PATENT NO. : 5,964,052

DATED : October 12, 1999

INVENTOR(S) : J. Scott Jepsen, et al.

It is certified that error appears in the above-indentified patent and that said Letters Patent is hereby corrected as shown below:

Column 5, claim 1, line 31, delete "two", and in its place, put in ---a pair---.

Signed and Sealed this

Twentieth Day of June, 2000

*Attest:*

Q. TODD DICKINSON

*Attesting Officer*

*Director of Patents and Trademarks*